US006768406B1

(12) United States Patent
Fiaccabrino

(10) Patent No.: US 6,768,406 B1
(45) Date of Patent: Jul. 27, 2004

(54) ELECTROMAGNETIC DEVICE FOR VALVE CONTROL

(75) Inventor: Calogero Fiaccabrino, Cergy (FR)

(73) Assignee: Johnson Controls Automotive Electronics, Osny (FR)

( * ) Notice: Subject to any disclaimer, the term of this patent is extended or adjusted under 35 U.S.C. 154(b) by 0 days.

(21) Appl. No.: 09/958,137

(22) PCT Filed: Apr. 7, 2000

(86) PCT No.: PCT/FR00/00896

§ 371 (c)(1),
(2), (4) Date: Oct. 5, 2001

(87) PCT Pub. No.: WO00/61922

PCT Pub. Date: Oct. 19, 2000

(30) Foreign Application Priority Data

Apr. 9, 1999 (FR) ..... 99 04472

(51) Int. Cl.[7] ..... H01F 7/08

(52) U.S. Cl. ..... 335/256; 335/220; 335/281

(58) Field of Search ..... 335/220–229, 335/256, 276, 281–2; 123/90.23–90.27, 90.1; 251/129.01–129.1, 129.15, 129.19

(56) References Cited

U.S. PATENT DOCUMENTS 5,548,263 A * 8/1996 Bulgatz et al. ..... 335/274

* cited by examiner

*Primary Examiner*—Lincoln Donovan
(74) *Attorney, Agent, or Firm*—Foley & Lardner LLP

(57) ABSTRACT

The apparatus for controlling valves that move linearly along respective axes comprises a number of actuators that is equal to the number of valves. Each actuator has an armature (22) of ferromagnetic material fixed to a valve push rod (24) and movable in a housing (16) of the actuator by a coil mounted on a ferromagnetic circuit. The ferromagnetic circuits of the two actuators allocated to two valves of the same type for a single cylinder are contained in the same housing.

7 Claims, 2 Drawing Sheets

FIG.1.
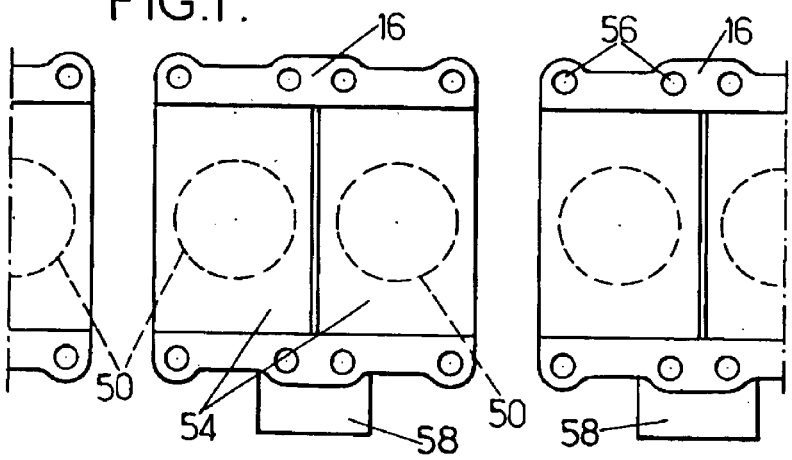
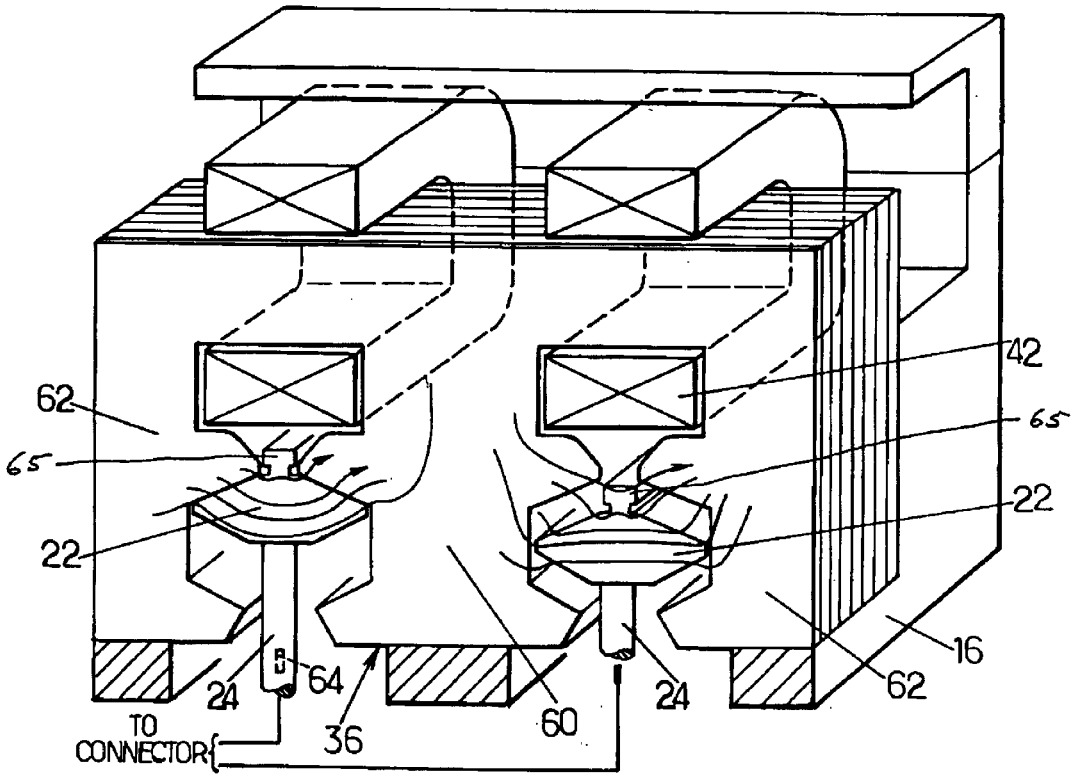
FIG.2.

ELECTROMAGNETIC DEVICE FOR VALVE CONTROL

The invention relates to apparatus for controlling valves that move linearly along respective axes, the apparatus comprising as many actuators as there are valves, each actuator having an armature of ferromagnetic material fixed to a valve push rod that is movable in a housing of the actuator by electromagnetic means having at least one coil mounted on a ferromagnetic circuit and having at least one return spring with one end bearing against the rod.

Apparatuses of this kind can have two opposing return springs (U.S. Pat. No. 4,614,170 or French patent application No. 98/12489) or a single spring working alternately in traction and in compression (French patent No. 2,783,631). The electromagnetic means of an actuator can have two coils which, when excited, tend to move the armature in opposite directions. It is also possible—and this solution is generally preferable for reasons of cost, compactness, and reducing the number of electrical connections—for them to use a single coil whose ferromagnetic circuit is of a structure such as to cooperate with the armature to provide two stable magnetic flux paths corresponding to a valve-open state and to a valve-closed state, repetitively (French patent No. 2,784,222 and corresponding European application).

Such apparatus has as many actuators as there are valves. On an engine having sixteen valves arranged in two rows, eight actuators need to be placed side by side. The power of an actuator is limited, forgiven thickness, and this thickness is itself limited because the actuators must be distributed in the same way as the valves. On engines of low cylinder capacity, the power which can be obtained with individual actuators can be insufficient, at least for exhaust valves since they are the most demanding under high engine loads because of the back pressure in the combustion chamber. Furthermore, the need for one electrical power connector per actuator is expensive and reduces reliability.

SUMMARY OF THE INVENTION

An object of the invention is to provide valve control apparatus for an engine having two valves of the same type per cylinder, having increased compactness and reliability To this end, the invention provides apparatus in which the ferromagnetic circuits of the two actuators allocated to two valves of the same type for a single cylinder are contained in a common housing, and the coils of the two actuators can consequently be powered by a single power connector. The single connector can additionally be used for conveying measurement signals to the outside from a sensor for sensing the position of the armature.

In another aspect, the invention provides apparatus in which the ferromagnetic circuits of two actuators allocated to two valves of the same type for a single cylinder are merged. Not only does this disposition reduce overall size and thus make it possible locally to increase the iron section by taking advantage of the empty space between two cylinders, but it also makes it possible to increase the section of the common portion which is entirely beneficial for driving a single one of the valves while the other one remains at rest, e.g. when starting valve oscillation.

The invention is particularly easy to implement with single-coil actuators where it is also possible for sensors for sensing the axial position of the rod and of the armature, by detecting the position of a permanent magnet fixed to the rod, to be placed in a zone where the magnetic flux created by the coil is always very small and does not disturb operation because of the symmetry of the planar graph of the stream lines.

The above characteristics and others will appear more clearly the following description of a non limiting embodiment. The description refers to the accompanying drawings.

BRIEF DESCRIPTION OF THE DRAWINGS

FIG. 1 is a plan view of a fraction of control apparatus having actuators grouped together in pairs in common housings;

FIG. 2 is a cross-sectional view through a pair of actuators constituting a particular embodiment, the section being on a plane containing the axes of the actuators.

DETAILED DESCRIPTION

Figure 3:
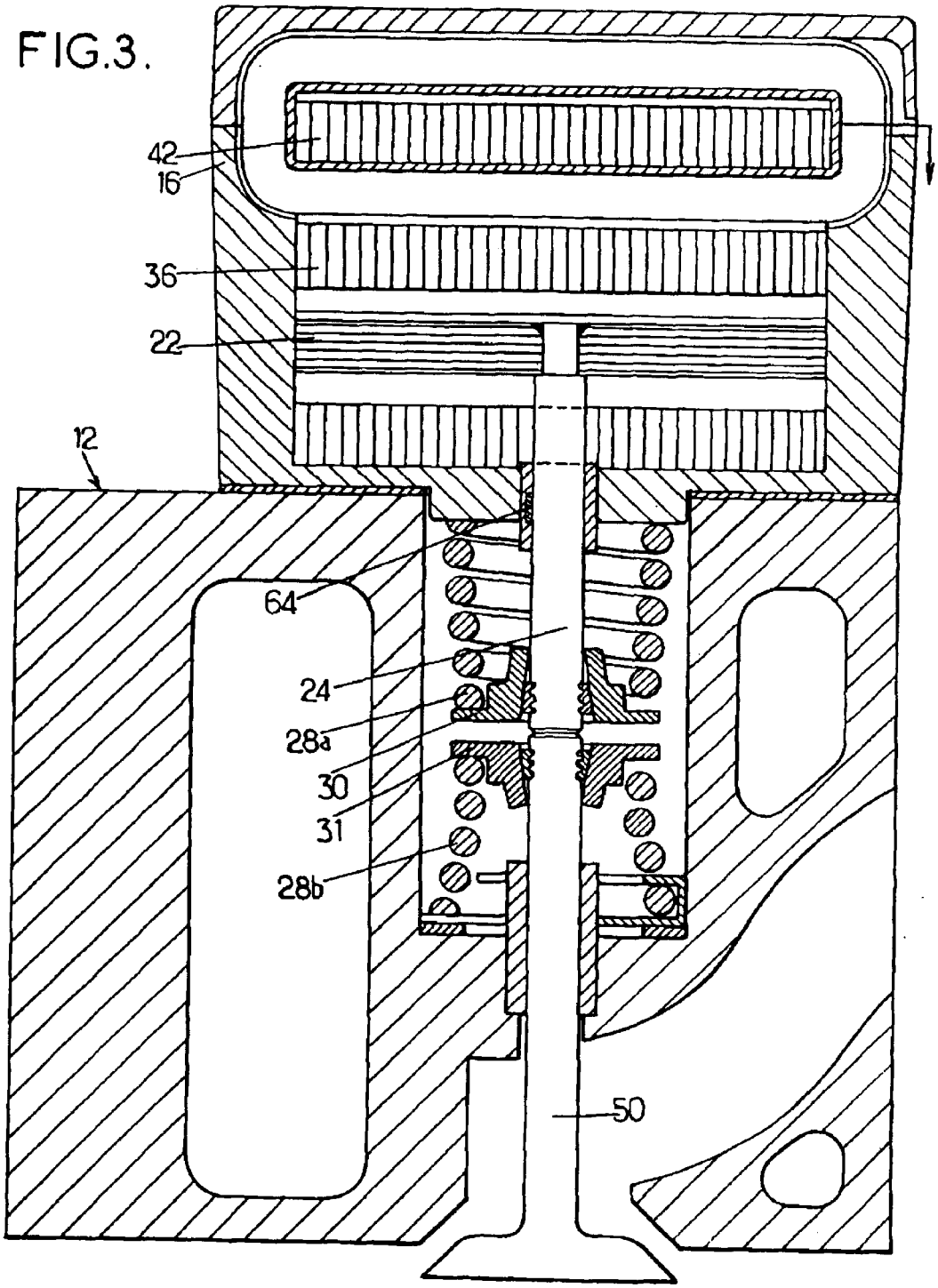
FIG. 3 is a cross-sectional view of a single-coil actuator, the section being on a plane orthogonal to that of FIG. 2 and containing the axis of an actuator.

The description below relates essentially to apparatus for an engine having two admission valves and two exhaust valves per cylinder. All of the valves of the same type, such as the valves 50 shown in FIG. 1, are placed in fine and the spacing between two vales associated with a given cylinder is smaller than the spacing between two adjacent valves associated with two different cylinders. The valve actuators are electromagnetically controlled and can be of the single-coil type, like the actuator described below, or of the two-coil type, as described in above-mentioned French patent No. 2,783,631.

The apparatus shown in part in FIG. 1 has a common housing 16 of non-magnetic material, e.g. of light alloy, containing the ferromagnetic circuits 54 of two adjacent actuators allocated to the same cylinder and located on the cylinder head of the engine. For this purpose, the housing has through holes 56 for receiving fixing screws. For two-coil actuators, the ferromagnetic circuits are generally separate so as to allow the two valves to be controlled individually.

The four coils in a given pair (two per actuator) can be powered via a single connector 58 whose general structure can either be conventional, or can advantageously be as described in the French patent application filed on the same day as the present application and entitled "Connecteur de puissance et dispositif d'alimentation d'actionneurs comportant de tels connecteurs" [Power connector and actuator feed apparatus including such connectors] in the name of the Applicant, however doubled. French patent No. 2,792,111. Such connectors can be designed also to transfer output signals from position sensors. This disposition requires less space than fitting actuators individually, and it requires only half of the number of connectors.

When the actuators are single-coil actuators, the magnetic circuits of two adjacent actuators can be merged and can have the structure shown in FIG. 2, each complete actuator having the elements shown in FIG. 3, for example. The vertical planes of symmetry of the two coils are further apart than the vertical planes of symmetry of the two armatures so that the magnetic flux generated by each of the coils interferes with the flux of the other coil as little as possible. The actuator then has an armature 22 of prismatic shape, made of ferromagnetic material, and fixed on a rod 24 for driving the valve 50.

Two return springs 28*a* and 28*b* are provided to keep the valve at rest in a substantially middle position between the valve-closed position and the valve-fully-open position. One of the springs 28*a* is compressed between a plate 30 fixed to the rod 24 and an extension of the housing 16. The other spring 28*b* is compressed between a plate 31 fixed to the valve stem and the bottom of the valve well formed in the cylinder head 12.

The fixed ferromagnetic circuit that is common to both actuators has a cross-section in a plane containing the axes of both armatures that is E-shaped with a middle branch 60 and two outer branches 62. The outer branches are of small width than the middle branch which takes advantage of the two magnetic circuits being merged. However these outer branches can be relatively wide because of the spacing between two cylinders.

In the embodiment shown in FIG. 2, each armature 22 has edges which are chamfered parallel to the poles of the associated magnetic circuit. In addition, the armature has a central bulge 65 in the form of a bar to create or increase asymmetry of the magnetic circuit and thus guarantee that the initial direction in which the armature moves starting from the rest position is upwards. In addition, the presence of the bulge 65 reduces the initial reluctance of the circuit because it reduces the air gap at rest, as shown by the arrows representing magnetic flux lines. When the armature is stuck to the top pole, as shown on the left of the figure, the bulge 65 is short-circuited and does not reduce the sticking force.

The currents carried by the two coils mounted on the same ferromagnetic circuit are opposite in direction. The current carried by each coil can be controlled by a controller (not shown) receiving a signal from a sensor giving the position of the armature. The sensor can be a Hall effect sensor 64 responsive to a magnetic tab carried by the rod 24. The path of the magnetic flux force lines is such that they do not interfere with measurement performed by a sensor placed in the plane of FIG. 3.

What is claimed is:

1. An apparatus for an internal combustion engine having a plurality of cylinders, comprising a plurality of engine valves which are rectilinearly axially movable along mutually parallel paths and a plurality of independently controllable actuators equal in number to a number of said plurality of engine valves, each of said actuators having:

a valve push rod rectilinearly axially movable in a housing, an armature of ferromagnetic material fixed to the respective push rod and movable in the housing by an electromagnet having at least one coil mounted on a ferromagnetic circuit, and at least one valve return spring with an end bearing against the rod, wherein a pair of actuators allocated to two valves of a same type associated with a same single engine cylinder have a common E shaped ferromagnetic circuit with a middle branch which is common to two actuators and extends between the armatures, and two separate outer branches.

2. Apparatus according to claim 1 wherein each of said actuators has a single coil.

3. Apparatus according to claim 2 wherein the coils of two associated actuators are fed via a common electrical connector.

4. Apparatus according to claim 3, wherein the common connector is provided for also transmitting measurement signals from a sensor for sensing a position of the armature.

5. Apparatus according to claim 2 wherein each of said armature has edges chamfered parallel to confronting poles of the ferromagnetic circuit.

6. Apparatus according to claim 2, wherein each armature has a central bulge in the form of a bar which creates or increases asymmetry of the ferromagnetic circuit to impose an initial direction on displacement of the armature from a rest position when said single coil is energized.

7. Apparatus according to claim 2, further comprising means for circulating electrical currents of opposite direction in the two coils mounted on the common ferromagnetic circuit.

* * * * *